United States Patent [19]

Politis et al.

[11] Patent Number: 4,761,263

[45] Date of Patent: Aug. 2, 1988

[54] PROCESS FOR PRODUCING FORMED AMORPHOUS BODIES WITH IMPROVED, HOMOGENEOUS PROPERTIES

[75] Inventors: Constantin Politis, Karlsruhe, Fed. Rep. of Germany; William L. Johnson, Pasedena, Calif.; Wolfgang Pflumm, Mossingen, Fed. Rep. of Germany

[73] Assignee: Kernforschungszentrum Karlsruhe GmbH, Karlsruhe, Fed. Rep. of Germany

[21] Appl. No.: 865,996

[22] Filed: May 22, 1986

[30] Foreign Application Priority Data

May 24, 1985 [DE] Fed. Rep. of Germany ..... 3518706
Mar. 29, 1986 [EP] European Pat. Off. ..... 86104368.5

[51] Int. Cl.[4] ..... B22F 1/00

[52] U.S. Cl. ..... 419/33; 419/38; 419/48; 419/49; 241/27; 264/15

[58] Field of Search ..... 419/33, 38, 48, 49; 241/27; 264/15

[56] References Cited

U.S. PATENT DOCUMENTS

| | | | |
|---|---|---|---|
| 3,832,156 | 8/1974 | Wilson et al. | 419/33 |
| 4,298,382 | 11/1981 | Stempin et al. | 75/202 |
| 4,381,197 | 4/1983 | Liebermann | 419/24 |
| 4,585,617 | 4/1986 | Tenhover et al. | 419/34 |

FOREIGN PATENT DOCUMENTS

| | | |
|---|---|---|
| 088578 | 9/1983 | European Pat. Off. . |
| 100850 | 2/1984 | European Pat. Off. . |

OTHER PUBLICATIONS

Chemical Abstracts, vol. 98, 1983, Abstract No. 98:226654b.

Chemical Abstracts, vol. 98, 1982, Abstract No. 78700e.

Chemical Abstracts, vol. 98, 1983, Abstract No. 98:64311h.

L. Schulz, "Preparation of Thick Amorphous Metals by Jelly Roll Technique and Rapid Diffusion", *Amorphous Metals and Nonequilibrium Processing*, Jun. 5 to 8, 1984, Strasbourg, France.

Koch et al., *Applied Physics Letters*, vol. 43 (11) Dec. 1983, pp. 1017–1019.

R. B. Schwarz, "Amorphization of Ni–Ti Alloys by Mechanical Alloying", *Fifth International Conference on Rapidly Quenched Metals, Abstracts*, Wuerzburg, Sep. 3 to 7, 1984, p. K 71.

*Primary Examiner*—Stephen J. Lechert, Jr.

*Attorney, Agent, or Firm*—Sughrue, Mion, Zinn, Macpeak, and Seas

[57] ABSTRACT

Process for producing formed bodies with improved homogeneous properties, high resistance to oxidation and corrosion, great hardness and firmness, good mechanical workability, and high resistance to abrasion, made out of an initial power material which contains two elemental metals; or one or more alloys; or one or more elemental metals and one or more alloys; or a combination of one or more elemental metals and/or one or more alloys with one or more metalloids and/or one or more non-metallic substances, except for formed bodies made of NiTi, of $Nb_3Sn$, of stoichiometric, binary intermettalic yttrium-cobalt compounds and gadolinium-cobalt compounds, and of $Ni_{60}Nb_{40}$, wherein the initial material, in metallic form or in the form of a hard material or a mixture thereof, is ground to a fine pulverized powder in a high-energy ball mill, and in which the fine powder is subsequently shaped into a formed body, comprising: conducting the fine pulverization of the powder in a dry, purified protective gas until it loses practically all of its crystalline properties, as proven by X-ray diffractometry, while employing a temperature during the milling process which is below the temperature at which crystallization first occurs, and employing a temperature, during the subsequent shaping which is below the temperature at which crystallization first occurs.

14 Claims, 10 Drawing Sheets

1 h 2 h 3 h

PROCESS FOR PRODUCING FORMED AMORPHOUS BODIES WITH IMPROVED, HOMOGENEOUS PROPERTIES

BACKGROUND OF THE INVENTION

The present invention relates to a process for producing formed bodies with improved isotropic properties, high resistance to oxidation and corrosion, great hardness and firmness, good mechanical tooling quality and high resistance to abrasion, made of elemental metals, or a combination of at least two metals, or a combination of one or more metals with one or several metalloids and/or one or more non-metallic elements, in which the initial materials in metallic form or in form of hard substances or mixtures thereof have been ground to fine amorphous powders in a high-energy ball mill. The powders are subsequently shaped into a formed body by pressing, sintering or hot-pressing at a higher temperature.

In the past, various techniques have been employed to make amorphous products. For example, ribbons of amorphous alloys have been made by rapid quenching of molten liquid alloys. In another technique for producing amorphous products, wires have been made of amorphous NiZr from 1 μm-thick elemental layers, layered one on top of the other, which were twisted around each other, and which were then mechanically deformed in accordance with swaging and wire drawing technology, by repeated drawing and hammering in a steel casing which was subsequently removed. By mechanical deformation of the wound nickel and zirconium foils and subsequent heat treating at 573° K. in an argon atmosphere (1 to 250 hours) the transition from the crystalline state to the amorphous state was accomplished by rapid diffusion of the nickel. See, L. Schulz, "Preparation of Thick Amorphous Metals by Jelly Roll Technique and Rapid Diffusion", *Amorphous Metals and Nonequilibrium Processing,* June 5 to 8, 1984, Strasbourg, France. Schulz also discloses the formation of a composite NiZr sheet by rolling technology. Schulz discloses that the sheet was not completely amorphous, and suggests that further deformation to form thinner layers would be needed.

The previously known procedures for producing bodies out of amorphous materials have the disadvantage that the transition from the crystalline to the amorphous state of the usable materials is often incomplete or achieved, if at all, only by very complicated processing.

It has also been disclosed that binary intermetallic compounds or, respectively, binary alloys in amorphous pulverized form were obtained by extensive pulverization of Ni and Nb powders, or Y and Co powders, or Gd and Co powders, or Nb and Sn powders, or Ni and Ti powders in a high energy ball mill (mechanical alloying), for instance $Ni_{60}Nb_{40}$ or yttrium-cobalt compounds or gadolinium-cobalt compounds or $Nb_3Sn$ (Koch et al, *Applied Physics Letters,* Volume 43 (11), of December 1983, pp 1017 to 1019) or NiTi (R. B. Schwarz, "Amorphization of Ni-Ti Alloys by Mechanical Alloying", *Fifth International Conference on Rapidly Quenched Metals, Abstracts,* Wuerzburg, 3 to 7 September 1984, p. K 71), but the formation of the amorphous alloy powders were observed only in the few cited instances. $Ni_{60}Nb_{40}$, for instance, was milled for 14 hours in the presence of air whereby the product material showed a low, broad exothermic crystallization peak in relation to the corresponding peaks on $Ni_{60}Nb_{40}$ materials which were produced in amorphous form by a different method. In order to minimize oxygen content, Koch et al disclosed that the powders can be loaded in a dry box containing helium. Schwarz discloses ball milling under a high purity nitrogen atmosphere. The production of formed bodies with improved isotropic properties was not addressed by these publications.

SUMMARY OF THE INVENTION

It is an object of the present invention to provide a process for producing formed bodies with improved homogeneous properties, high resistance to oxidation and corrosion, great hardness and firmness, good mechanical tooling quality and high resistance to abrasion which creates products that have, for all practical purposes, no macroscopic or open porosity and which can be produced with relatively little effort, equipment, and cost.

Another object of the present invention is to provide such a process which produces formed bodies of high density, that is to say, bodies with a nearly 100% theoretical density (TD).

A further object of the present invention is to provide such a process in which the transition from the crystalline to the amorphous state should be practically complete.

Additional objects and advantages of the present invention will be set forth in part in the description or can be learned by practice of the invention. The objects and advantages are achieved by means of the processes, instrumentalities and combinations particularly pointed out in the appended claims.

To achieve the foregoing objects and in accordance with its purpose, the present invention provides a process for producing formed bodies with improved homogeneous properties, high resistance to oxidation and corrosion, great hardness and firmness, good mechanical workability, and high resistance to abrasion, made out of an initial powder material which contains two elemental metals; or one or more alloys; or one or more elemental metals and one or more alloys; or a combination of one or more elemental metals and/or one or more alloys with one or more metalloids and/or one or more non-metallic substances, except for formed bodies made of NiTi, of $Nb_3Sn$, of stoichiometric, binary intermetallic yttrium-cobalt compounds and gadolinium-cobalt compounds, and of $Ni_{60}Nb_{40}$, wherein the initial material, in metallic form or in the form of a hard material or a mixture thereof, is ground in a dry state to a pulverized fine powder in a high-energy ball mill, and in which the fine powder is subsequently shaped into a formed body, comprising: conducting the fine pulverization of the powder by grinding in a dry, purified protective gas until it loses practically all of its crystalline properties, as proven by X-ray diffractometry, while employing a temperature during grinding which is below the temperature at which crystallization first occurs, and employing a temperature during the subsequent shaping into a formed body which is below the temperature at which crystallization first occurs.

The subsequent shaping of the fine powder into the formed body can occur, for example by pressing, sintering as one of the possible techniques or hot-pressing at a raised temperature as another.

In a preferred embodiment of the present invention, the weight ratio "sum of the balls in the ball mill" to "powder" should be between 3:1 and 10:1. The volume of the powder to be pulverized plus the volume of the balls is preferably 5 to 45% of the volume of the pulverization volume in the ball mill.

For carrying out the process in accordance with the present invention, it is preferred if the processing temperature during the fine pulverization and during the subsequent shaping of the fine powder into a formed body as by pressing, sintering, and continued processing is not higher than 0.9 of the crystallization temperature.

In one preferred embodiment of the present invention, titanium and copper powders are employed in combination, at an atomic ratio of 5% to 95% of Cu to the remainder of Ti, and these metals preferably are pulverized at 300° to 350° K. The subsequent shaping of the powder into a formed body, as by pressing, sintering, hot-pressing, isostatic hot-pressing, heat extrusion-pressing or further compressing and processing through shock waves or repercussion waves, or impact compaction, is preferably performed from 540° to 610° K.

In another preferred embodiment of the present invention, Nb and Ge elemental powders and alloy powders, or Nb and Ge and Al elemental powders, or Nb, Ge, Al and Si elemental powders or Nb and Si elemental powders are pulverized at a temperature from 300° to 350° K., and the subsequent shaping into a formed body as by pressing, sintering and further processing is below 500° K.

In a further preferred embodiment of the present invention, the finely pulverized amorphous powder, before being processed into the formed bodies, is mixed with an additional powder of polycrystalline substances or microcrystalline hard material powders or ceramic powders or powders of intermetallic compounds, with the additional powder being homogeneously distributed in the amorphous powder. The amorphous powder is used as a matrix and the additional powders are used as dispersed particles.

It is to be understood that both the foregoing general description and the following detailed description are exemplary and explanatory, but are not restrictive of the invention.

DETAILED DESCRIPTION OF THE INVENTION

Figure 1:
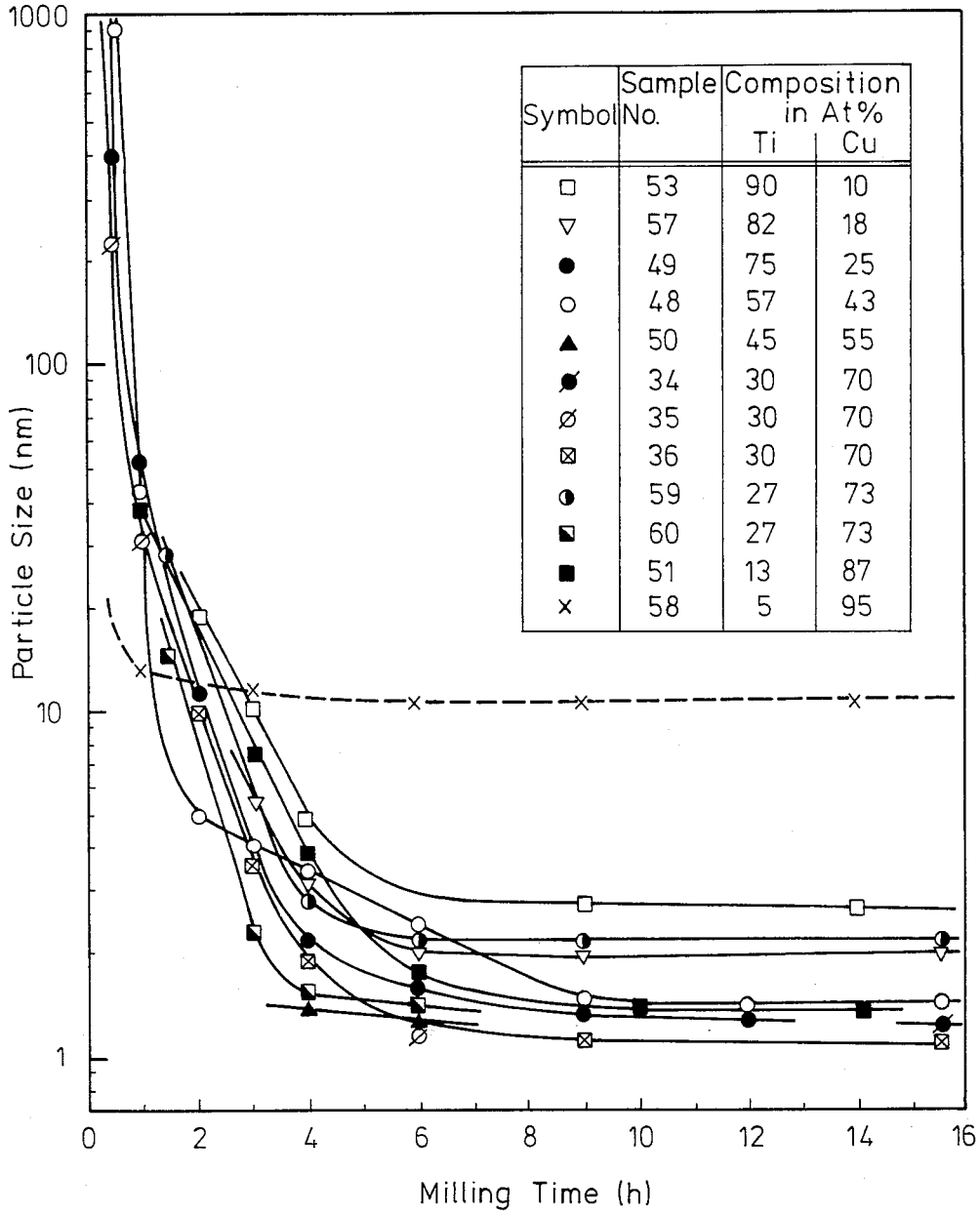
FIGS. 1 to 9 show curves representing various aspects of the present invention, as explained more fully below.

In the present invention, starting or initial powder materials are ground in a ball mill to obtain a fine powder of amorphous material, and the fine powder then is shaped into a formed body by processes such as pressing, sintering, hot-pressing, isostatic hot-pressing, heat extrusion pressing or further compressing and processing through shock waves or repercussion waves or impact compaction. The term "ball mill" as used throughout the specification and claims includes the following: tumbler ball mill, vibratory ball mill, attrition ball mill, centrifugal planetary ball mill, and oscillating disk ball mill.

Under the concept of formed bodies the following is meant by way of example: tools and forms for the production of tools; rotationally symmetric formed bodies for ballistic applications; toothed gears; axles; cylindrical bodies, e.g. for testing properties of, e.g. pellets, disks, rings; body forms for annular magnets; balls for, e.g., high-efficiency ball bearings; superconductive bodies, such as rods, wires, sheet metals, spools, and foils; turbine blades and turbine wheels; oil and mineral exploration tools.

The initial powder materials which can be employed in the present invention are transformed into amorphous form as a result of the fine pulverization. The initial material contains metal and can contain at least one component which is a metalloid or a non-metallic element. The metal in the initial material can be in the form of (a) elemental metal powder or (b) a metal alloy powder of at least two metals, or (c) a hard material which contains metal and a non-metallic element or a metalloid. Mixtures of these forms can be used. Metals particularly well-suited for use in the present invention to produce formed bodies include Al, Ti, Hf, Pd, Cr, Fe, Co, Ni, Cu, Zr, Nb, Mo, Ru, Rh, V and W.

Particularly well-suited metalloids or non-metallic elements for use in the present invention are: C, N, B, Ge, Si, S and P.

The process according to the present invention can also be applied to powders which are very soft and plastic and/or have very low melting temperatures, such as Pb-Sn, Pb-In, Ga-In-Pb, if the milling container is cooled during the pulverization and "amorphization" process. Substances such as air, water, or liquified gases, e.g. liquid nitrogen, can be used as coolant. Good results were achieved with liquid nitrogen when Ti alloys, rich in Pd and Cu, were "amorphisized".

The interior of the container and the balls of the ball mill must be clean, free of oil and grease, and dry. Appropriate protective gases include helium, argon, nitrogen and hydrogen.

The powder mixtures listed in the following Table were ground in a high-energy ball mill, whose milling container was rounded on the inside to prevent dead space between the floor and the side walls, whereby the radius of the curvature is larger or equal to the radius of the largest milling ball. Such grinding containers can be made of hard material such as tool steel or tungsten carbide. Balls with different radii and made of such materials as highly-tempered steel, hard materials or hard metals such as WC/6% Co, for instance, may be used. The diameters of the balls may range between 2 mm and 12 mm, depending on the diameter of the inside of the milling container (in a laboratory ball mill for instance, 25 mm to 50 mm diameter; 50 to 80 mm height). The material for the balls and containers can also be hardened Cu-Be alloys or be the same material as the powder to be ground, if previously appropriately hardened. In the current cases, involving the powder mixtures listed below, balls of 6, 8 mm and 10 mm diameter appear to be the most suitable. The weight ratio between the balls and powder during the individual tests was always in the range between 3 to 1 and 10 to 1. Argon with a purity in excess of 99.999% was used as protective gas. In Experiments 1, 5, 9, 17, 18 and 19, a number of different starting mixtures containing different amounts of the elements were employed to separately produce alloys having varying contents of the elements. The ranges shown in these experiments represent the alloy content of the various separately produced alloys.

In experiments 1, 9, 15, 18 and 26 both elemental powders and alloy powders have been used as initial materials; otherwise elemental powders were used.

Also, in experiment 1 grinding was performed at a temperature of 300° K., pressing at the same temperature, and subsequent sintering and hot-pressing was performed at 540° to 610° K., all below the crystallization temperature of 605° to 680° K. In experiment 1 it was shown that grinding at 80° K. produced amorphous powders over a wider compositional range than at 300° K., which was the grinding temperature used in all experiments unless stated otherwise. In experiments 1 to 30, the starting powders had particle sizes of 1 to 400 μm.

| Exp. No. | Combination of Elements | Examples of Amorphous Alloys, Obtained with Process of Invention | Complete Transition to Amorphous State (in hours) | Crystallization temperature $T_x$(K.) | Ratio $\frac{T_x}{T_m}$ |
|---|---|---|---|---|---|
| 1* | Ti—Cu | $Ti_{95}Cu_5$ to $Ti_5Cu_{95}$ | 6 | 605 to 680 | 0.48 to 0.6 |
| 2 | Cu—Zr | $Cu_{65}Zr_{35}$ | 6 | 820 | 0.71 |
| 3 | Ru—Zr | $Ru_{21}Zr_{79}$ | 9 | — | — |
| 4 | Zr—Rh | $Zr_{75}Rh_{25}$ | 9 | 695 | 0.52 |
| 5 | Ni—Zr | $Ni_{66}Zr_{34}$ to $Ni_{15}Zr_{85}$ | 9 | 670 to 860 | 0.49 to 0.7 |
| 6 | Ti—Ni—Si | $Ti_{40}Ni_{40}Si_{20}$ | 12 | 1050 | ~0.7 |
| 7 | Ni—Si | $Nb_{75}Si_{25}$ | 6 | 690 | 0.26 |
| 8 | Nb—Al | $Nb_{72}Al_{28}$ | 6 | 610 | 0.27 |
| 9* | Nb—Ge | $Nb_{42}Ge_{58}$ to $Nb_{82}Ge_{18}$ | 6 | 600 to 700 | 0.25 to 0.37 |
| 10 | Nb—Ge—Al | $Nb_{75}Ge_{12}Al_{13}$ | 6 | 550 | 0.28 |
| 11 | Nb—Al—Ge | $Nb_{70}Al_{28}Ge_2$ | 6 | 580 | 0.28 |
| 12 | Nb—Ge—Al—Si | $Nb_{75}Ge_{10}Al_{10}Si_5$ | 6 | 560 | 0.28 |
| 13 | Mo—Si—B | $Mo_{70}Si_{20}B_{10}$ | 12 | >1100 | ~0.5 |
| 14 | Ti—Si—Fe | $Ti_{72}Si_{16}Fe_{12}$ | 12 | 880 | ~0.7 |
| 15* | Fe—Ni—B | $Fe_{40}Ni_{40}B_{20}$ | 16 | 730 | 0.46 |
| 16 | Fe—C—Cr—Mo—W | $Fe_{42}C_{18}Cr_{18}Mo_{16}W_6$ | 8 | 1030 | ~0.6 |
| 17 | Fe—Zr | $Fe_{40}Zr_{60}$ to $Fe_{15}Zr_{85}$ | 10 | 750 to 810 | 0.48 to 0.51 |
| 18* | Co—Zr | $Co_{60}Zr_{40}$ to $Co_{15}Zr_{85}$ | 10 | 720 to 905 | 0.43 to 0.56 |
| 19 | Hf—Ni | $Hf_{88}Ni_{12}$ to $Hf_8Ni_{92}$ | 12 | 780 to 920 | 0.48 to 0.6 |
| 20 | Fe—Ni—B—Si | $Fe_{40}Ni_{40}B_{13}Si_7$ | 12 | 800 | — |
| 21 | Pd—Ti | $Pd_{15}Ti_{85}$ to $Pd_{60}Ti_{40}$ | 6 | 550 to 800 | 0.32 to 0.46 |
| 22 | Pd—Si | $Pd_{80}Si_{20}$ | 6 | 670 | 0.65 |
| 23 | Pd—Cu—Ti | $Pd_{30}Cu_{40}Ti_{30}$ | 6 | 690 | 0.4 |
| 24 | Pd—Cu—Si | $Pd_{78}Si_{16}Cu_6$ | 6 | 705 | 0.6 |
| 25 | Co—Fe—Si—B | $Co_{70}Fe_5Si_{15}B_{10}$ | 6 | 830 | 0.5 |
| 26* | Fe—Si—B | $Fe_{77}Si_{10}B_{13}$ | 12 | 825 | 0.48 |
| 27 | Ru—Zr—B | $Ru_{42}Zr_8B_{50}$ | 16 | — | — |
| 28 | Co—Ti | $Co_{15}Ti_{85}$ to $Co_{90}Ti_{10}$ | 9 | 800 | 0.48 to 0.54 |
| 29** | WC—Cu—Zr | $Cu_{65}Zr_{35}$ + 8 Vol. % WC | 12 | ~800 | ~0.7 |
| 30** | $Al_2O_3$—Ti—Ni—Si | $Ti_{40}Ni_{40}Si_{20}$ + 5 Vol. % $Al_2O_3$ | 12 | ~1000 | ~0.7 |

— not investigated (not measured)
*formed both from elemental powders and from alloy powder
**composites to microcrystalline and amorphous phases.

Formed bodies which have been produced by pressing, sintering, hot-pressing and hot isostatic pressing (HIP) of such amorphous powders require less production energy and less equipment and show a higher density—almost 100% TD—higher resistance to abrasion, improved electrical and magnetic properties and, to the extent that superconductivity is expected, better workability and better superconductive properties.

The present invention provides a process which produces products with, for all practical purposes, no macroscopic or, respectively, open porosity, and by which formed bodies of high density—that is a density of almost 100%—can be produced with a relatively small amount of equipment and relatively low costs. Moreover, the transition of the materials from the crystalline state to the amorphous state is practically total.

FIG. 1 shows the effective size of particles in nm of $Ti_{1-x}Cu_x$ powder made according to the present invention as a function of the milling time in relation to the composition of the alloys be percentage of atoms.

Figure 2:
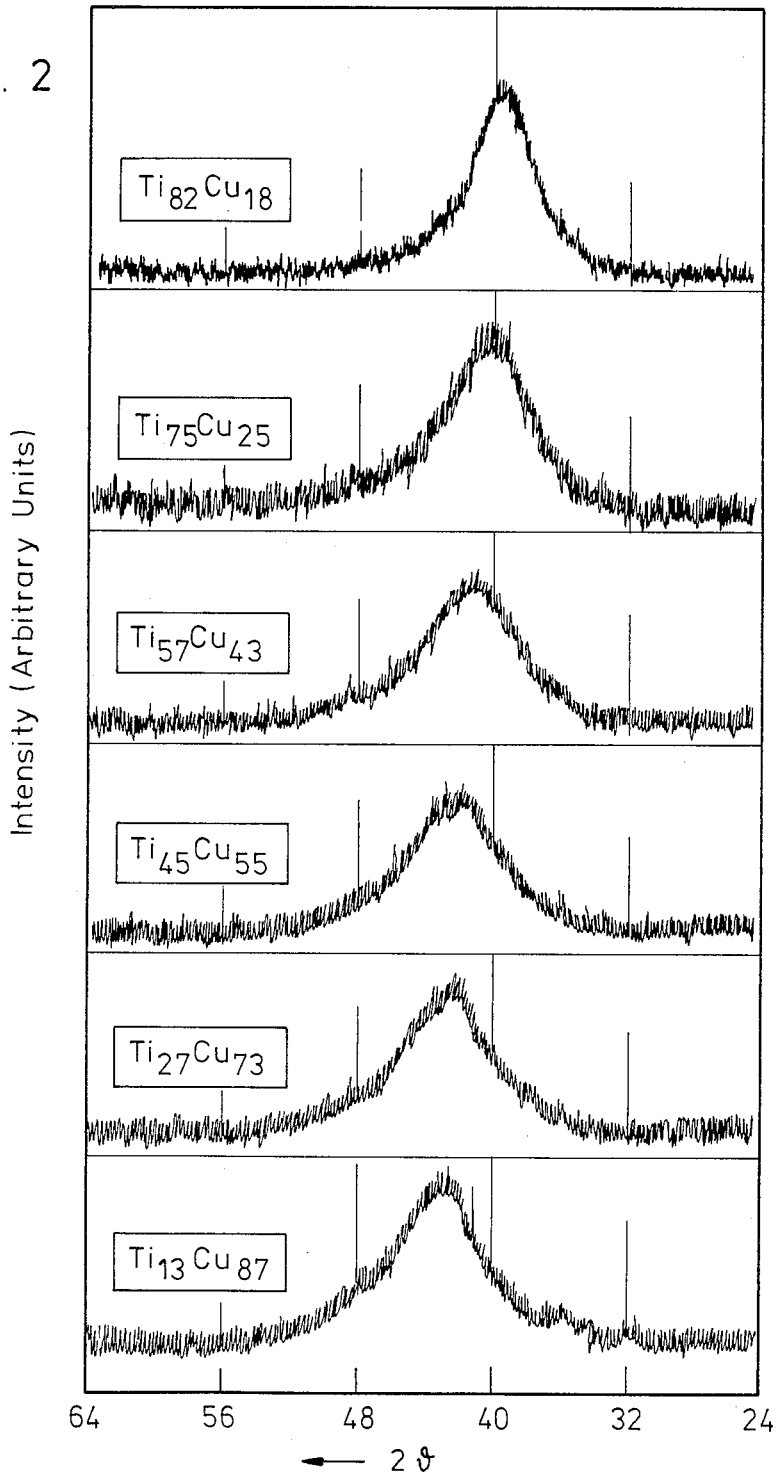

FIG. 2 shows X-ray diffractograms (Cu K-alpha radiation) of various $Ti_{1-x}Cu_x$ alloys of FIG. 1 after 6 h of grinding. The curves indicate that with increased Cu concentration the peaks are shifted to higher 2-theta values. From the shape of the curves, or the shape of the peaks, it can be seen that the alloy powders have reached the amorphous state.

Figure 3:
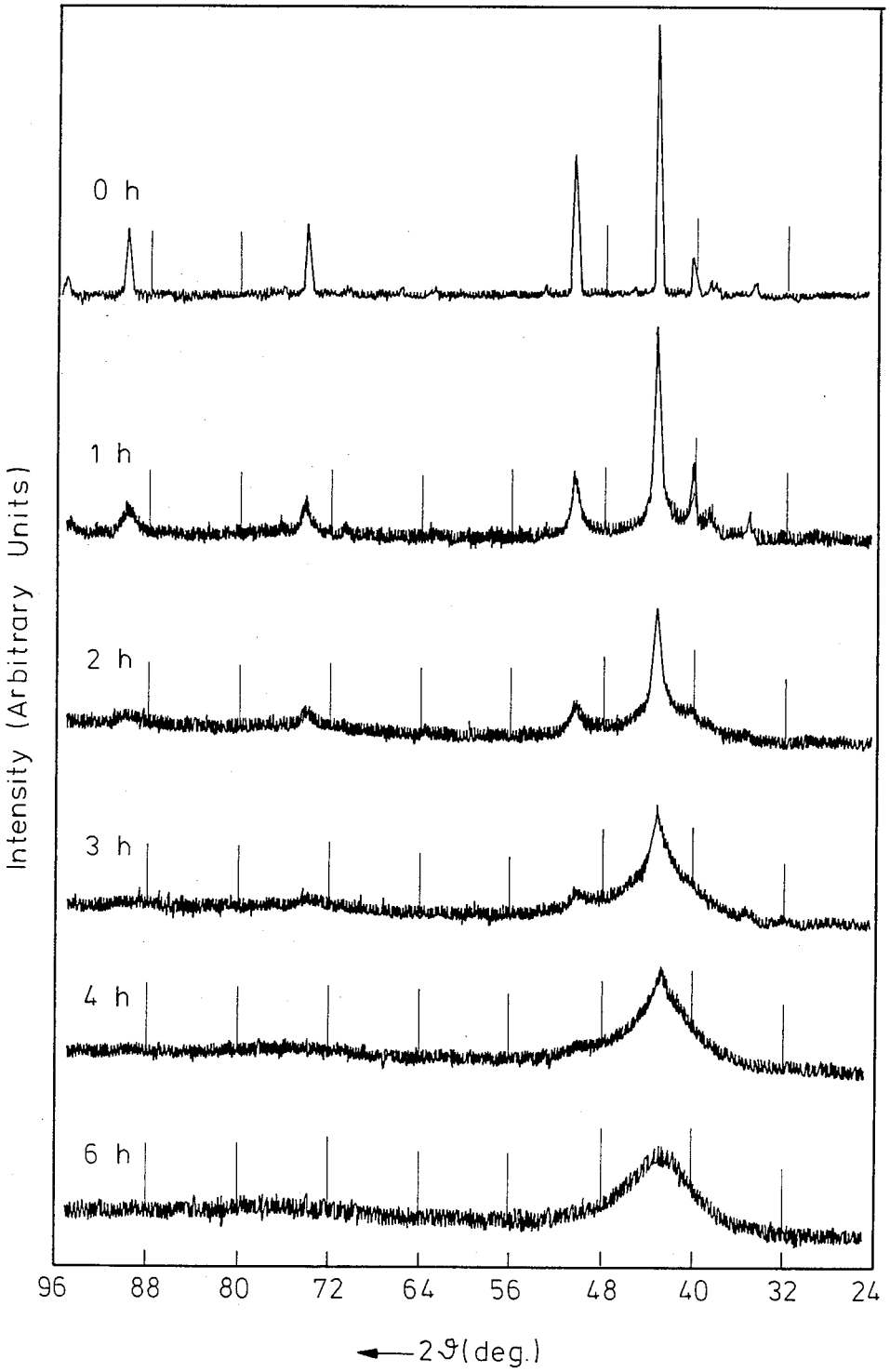

FIG. 3 shows the development with time of the amorphization process of the alloy $Ti_{57}Cu_{43}$ in accordance with the present invention.

Figure 4:
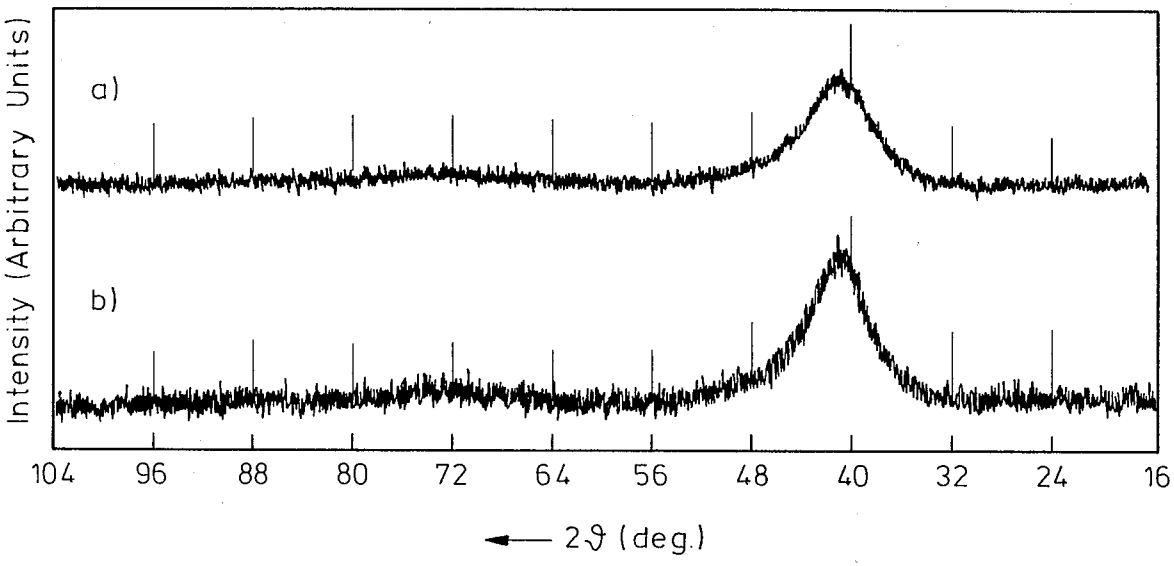

FIG. 4 shows the X-ray diffractogram of the alloy $Ti_{57}Cu_{43}$, with curve (a) showing the diffractogram as produced with the amorphous powder formed after 6 h of grinding by the process in accordance with the present invention, and curve (b) showing, for comparison, the diffractogram of an amorphous splat of the same chemical composition produced by rapid quenching from the liquid state (splat cooling).

Figure 5:
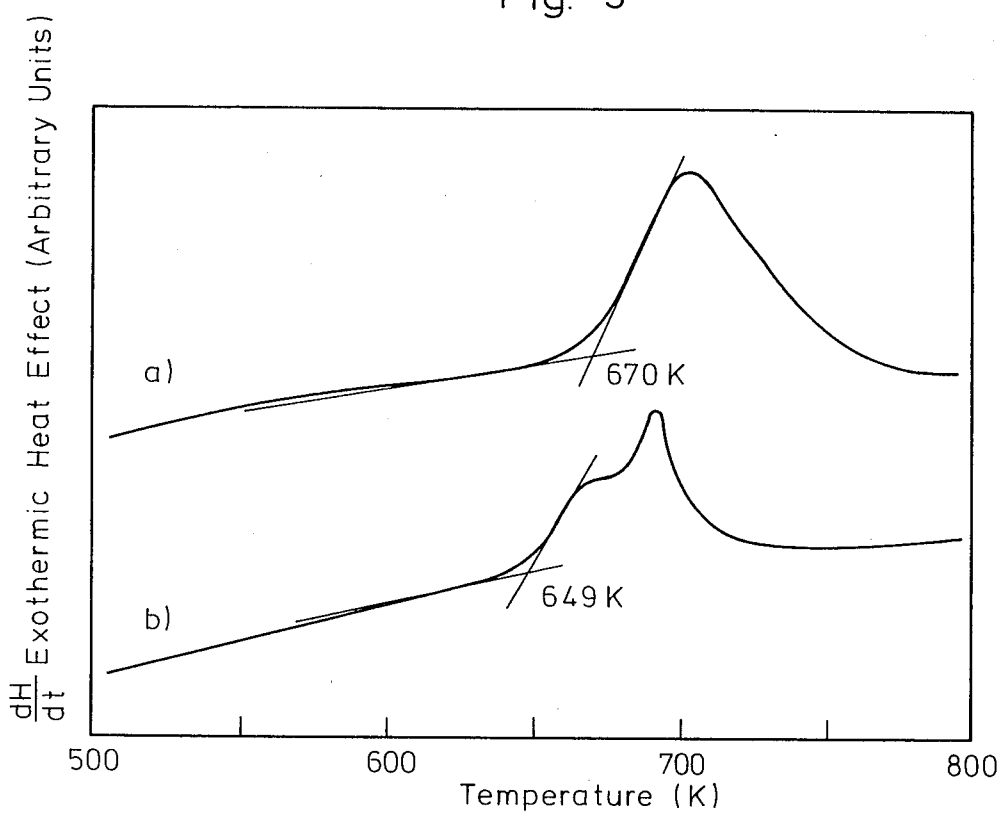

FIG. 5 shows the differential thermal analysis (DTA) curves associated with the alloy products of FIG. 4.

Figure 6:
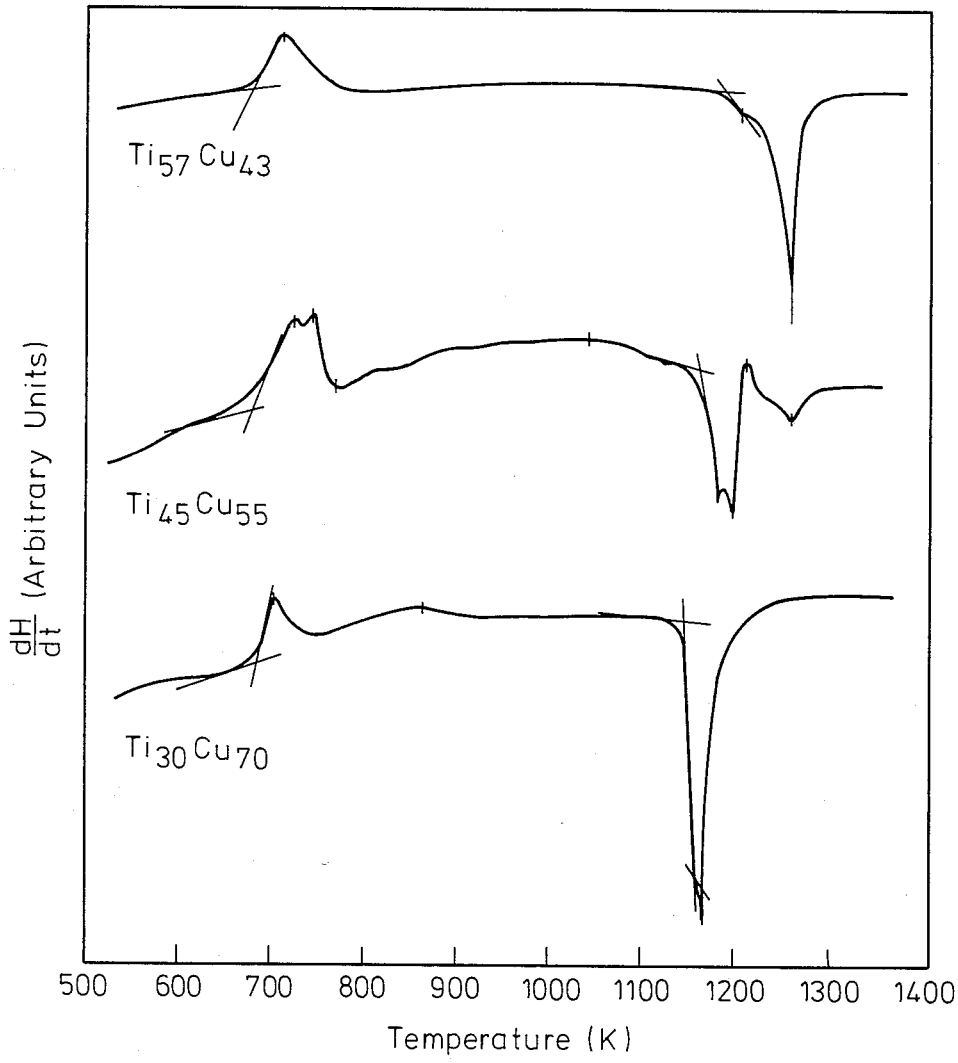

FIG. 6 shows several other examples of DTA curves of alloy powders according to the present invention in relation to one another ($Ti_{57}Cu_{43}$; $Ti_{45}Cu_{55}$; $Ti_{30}Cu_{70}$).

Figure 7:
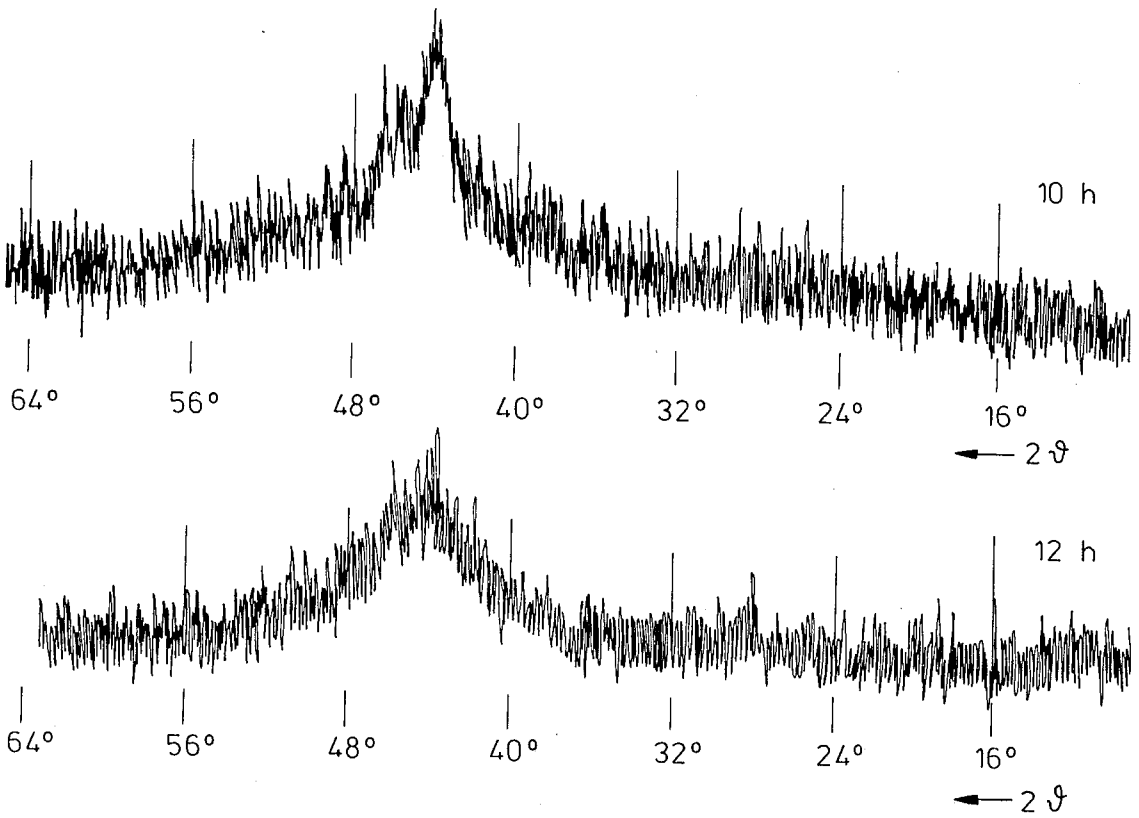

FIG. 7 shows diffractometer pictures of two formed bodies made of $Fe_{40}Ni_{40}B_{20}$ pulverized for 10 and 12 hours respectively, then hot-pressed at 660° K.

Figure 8:
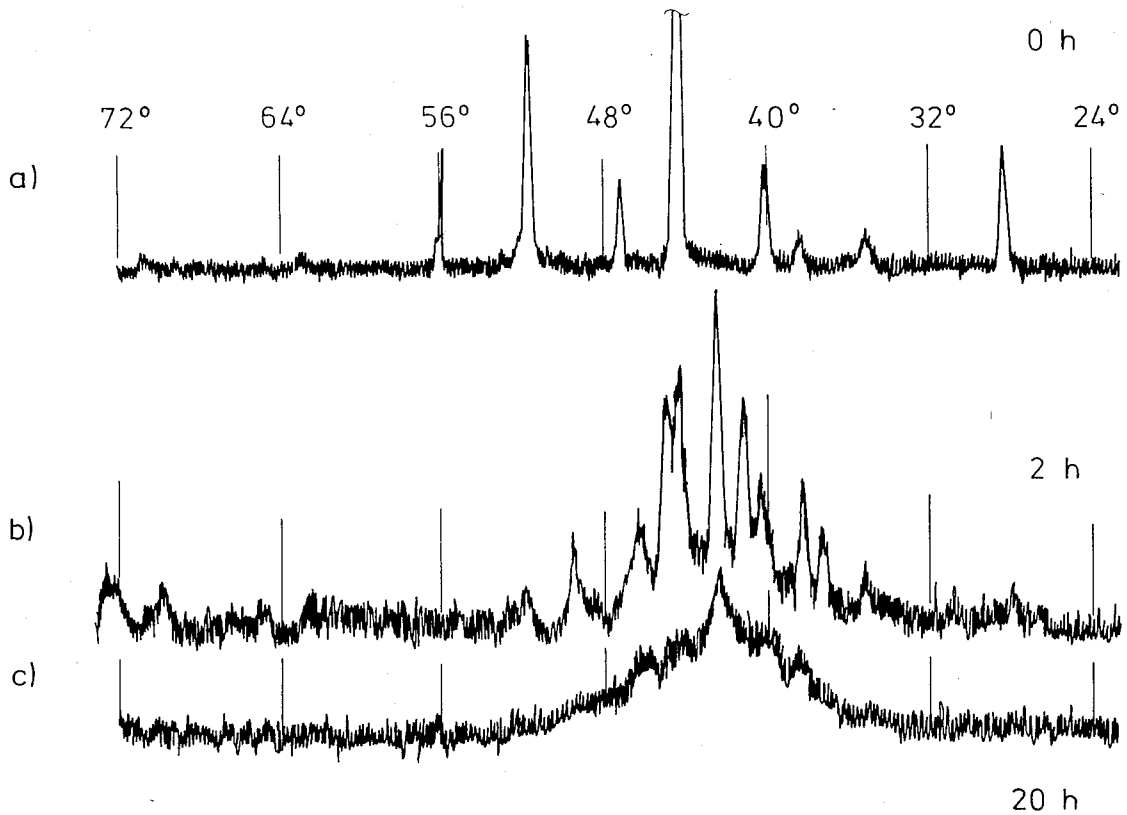

FIG. 8 shows the diffractometer curves of three bodies made of $Ni_{40}Ti_{40}Si_{20}$ pulverized for 0, 2, and 20 hours respectively, then hot-pressed at 950° K.

Figure 9:
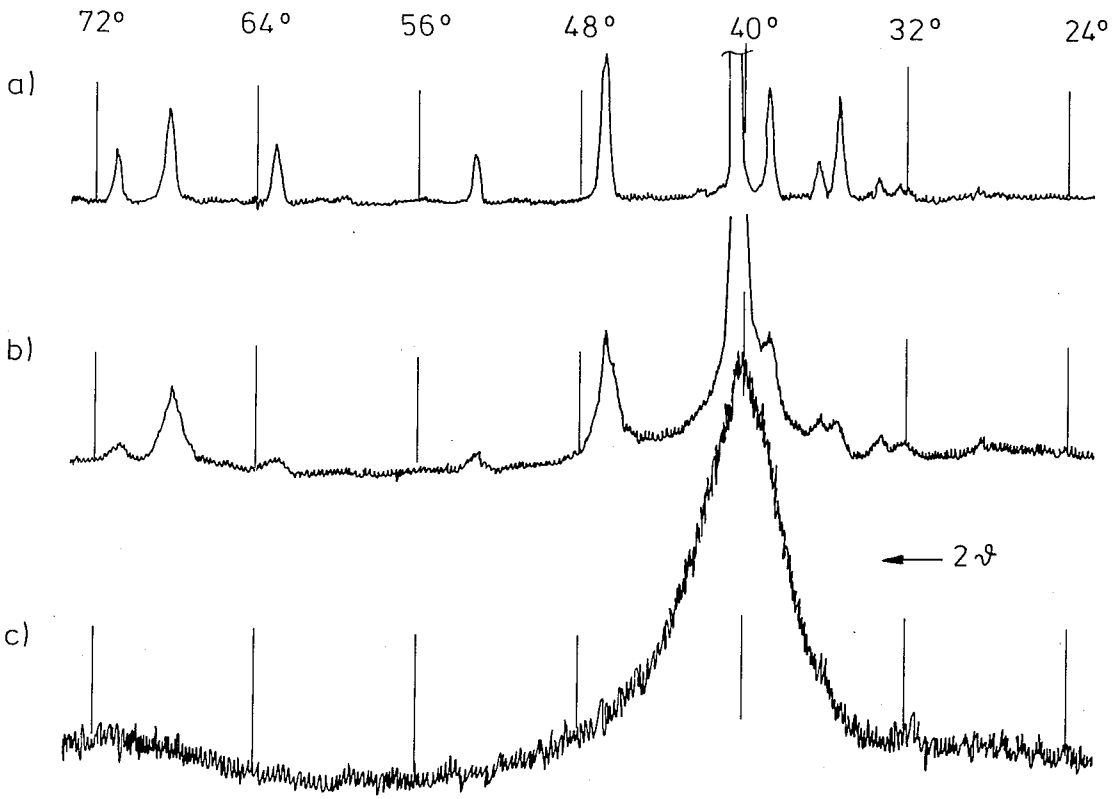

FIG. 9 shows three diffractometer curves, with curve (c) showing the diffractogram of a formed body, produced by hot-pressing, of the composition $Pd_{34}Ti_{66}$, after 20 hours of milling and subsequent hot-pressing at 650° K.; curve (a) showing, for comparison, the diffractogram of the untreated initial mixture of the pure components Pd and Ti; and curve (b), showing for comparison, the diffractogram of the mixture after 3 hours of pulverization. One can see that the formed body is still amorphous after hot-pressing at 650° K.

Figure 10:
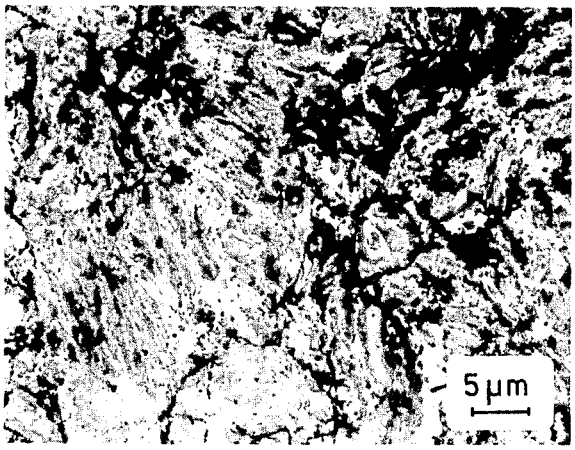
Figure 10:
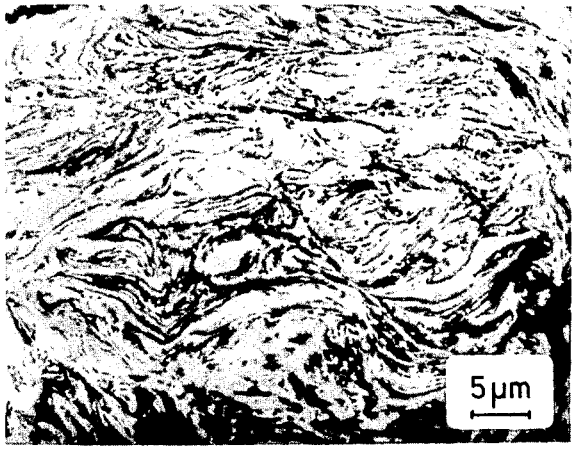
Figure 10:
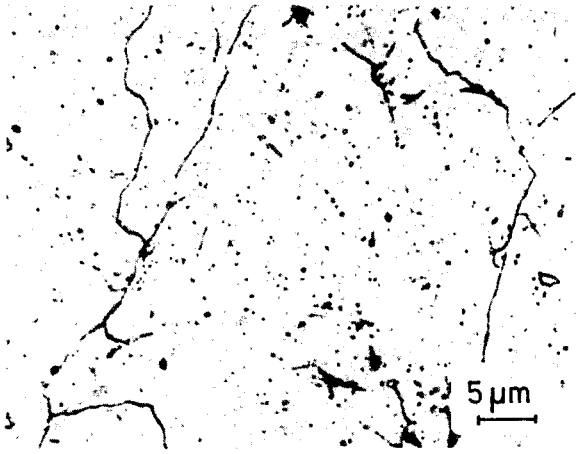

FIG. 10 shows the microstructure of three samples hot-pressed at 610° K., prepared from $Ti_{30}Cu_{70}$ powders after grinding for 1, 2 and 3 hours respectively.

Tests with differential thermo analysis (DTA) and differential scanning calorimetry (DSC) show that with the same chemical composition the crystallization temperatures for such amorphous powders are very close to the crystallization temperatures of amorphous splats or ribbons which have been produced by splat cooling and melt spinning techniques.

The major advantages in producing amorphous powders by mechanical alloying are that by using this method and by using the customary compression practices such as pressing, sintering, hot isostatic pressing, rolling, extrusion pressing and compacting with various explosive procedures, compact while the applied temperature is lower than the crystallization temperature. Amorphous ribbons, splats, thin films or partially amorphous powders (RSR technology) can be produced by well-known smelting methods; however, the procedures according to this invention provide a widely applicable method for the production of macroscopic, 100% amorphous homogeneous bulk objects.

In addition to the formation of fully amorphous powder, the process can produce multiphase material containing a uniform dispersion of fine microcrystalline particles. This is illustrated in FIG. 3 for $Ti_{57}Cu_{43}$ alloy after 2 and 3 hours of processing time; in FIG. 8 for $Ni_{40}Ti_{40}Si_{20}$ after 2 hours; and in FIG. 9 for $Pd_{34}Ti_{66}$ after 3 hours. Futhermore the fraction of microcrystalline component can be varied by controlling the length of processing time; compare the curves in FIG. 3 for 2 vs 3 hours of processing. The possibility of incorporating microcrystalline material by the invention gives further control over the properties of material produced using the process.

It will be understood that the above description of the present invention is susceptible to various modifications, changes and adaptations, and the same are intended to be comprehended within the meaning and range of equivalents of the appended claims.

What is claimed is:

1. Process for producing formed bodies with improved homogeneous properties, high resistance to oxidation and corrosion, great hardness and firmness, good mechanical workability, and high resistance to abrasion, made out of an initial powder material which contains two elemental metals; or one or more alloys; or one or more elemental metals and one or more alloys; or a combination of one or more elemental metals and/or one or more alloys with one or more metalloids and/or one or more nonmetallic substances, except for formed bodies made of NiTi, of $Nb_3Sn$, of stoichiometric, binary intermetallic yttrium-cobalt compounds and gadolinium-cobalt compounds, and of $Ni_{60}Nb_{40}$, wherein the initial material, in metallic form or in the form of a hard material or a mixture thereof, is ground in a dry state to a fine pulverized powder in a high-energy ball mill, and in which the fine powder is subsequently shaped into a formed body, comprising: conducting the fine pulverization of the powder by grinding in a dry, purified protective gas until it loses practically all of its crystalline properties, as proven by X-ray diffractometry, while employing a temperature during the grinding which is below the temperature at which crystallization first occurs, and employing a temperature during the subsequent shaping into a formed body which is below the temperature at which crystallization first occurs.

2. Process according to claim 1, wherein the subsequent shaping of the fine powder into a formed body comprises pressing, sintering, hot-pressing or isostatic hot-pressing, or heat extrusion-pressing at a raised temperature or further compressing and processing through shock waves or repercussion waves, or impact compacting.

3. Process in accordance with claim 1, wherein the weight ratio "sum of balls in the ball mill" to "powder" is in the range of 3:1 and 10:1.

4. Process in accordance with claim 1, wherein the volume of the powder to be ground plus the volume of the balls amounts to 5 to 45% of the volume of the milling space in the ball mill.

5. Process in accordance with claim 1, wherein the maximum processing temperature during pulverization and subsequent shaping is not higher then 0.9 of the crystallization temperature.

6. Process in accordance with claim 1, wherein the initial material comprises Ti and Cu powder in an atomic ratio of 5% to 95% of Cu to the remainder of Ti.

7. Process in accordance with claim 6, wherein the initial material is pulverized at 300° to 350° K.

8. Process according to claim 7, wherein the subsequent shaping is at a temperature from 540° to 610° K.

9. Process according to claim 8, wherein subsequent shaping comprises pressing, sintering, hot-pressing, hot isostatically pressing, heat extrusion-pressing, or through percussion waves, shock waves, or impact compaction compressing.

10. Process in accordance with claim 1, wherein the initial material is Nb and Ge elemental and alloy powders, or Nb and Ge and Al elemental powders, or Nb, Ge, Al and Si elemental powders, or Nb and Si elemental powders and is ground at a temperature from 300° to 350° K.

11. Process according to claim 10, wherein the subsequent shaping is at a temperature below 500° K.

12. Process according to claim 11, wherein the subsequent shaping comprises pressing, sintering, or hot-pressing.

13. Process in accordance with claim 1, wherein the finely pulverized powder, before it is processed into a formed body, is mixed with an additional powder of a polycrystalline or microcrystalline powder of a hard material, or ceramic powder, or powder of an intermetallic compound, and the additional powder is homogeneously distributed in the amorphous powder.

14. Process according to claim 13, wherein the amorphous powder is used as matrix and the additional powder is used as dispersed particles.

* * * * *